United States Patent [19]

Murakami

[11] 3,936,179

[45] Feb. 3, 1976

[54] SUPPORT STRUCTURE FOR A DUPLICATOR OPTICAL SYSTEM

[75] Inventor: Shinichi Murakami, Ebina, Japan

[73] Assignee: Rank Xerox Ltd., London, England

[22] Filed: Dec. 11, 1974

[21] Appl. No.: 531,590

[30] Foreign Application Priority Data

Dec. 24, 1973 Japan ..... 48-146925

[52] U.S. Cl. ..... 355/11; 108/6; 248/180; 355/66; 355/133

[51] Int. Cl.² ..... G03G 15/00

[58] Field of Search ..... 355/11, 8, 66, 133, 3 R, 355/3 DR; 248/188.2, 178, 180; 108/144, 6; 33/385, 174 TA, 174 TC

[56] References Cited

UNITED STATES PATENTS

| | | | |
|---|---|---|---|
| 2,807,190 | 9/1957 | Oldenboom | 355/66 X |
| 3,051,044 | 8/1962 | McNaney | 355/11 X |
| 3,698,804 | 10/1972 | Cranskens | 355/11 X |

*Primary Examiner*—Richard L. Moses

[57] ABSTRACT

An optical system for a duplicator machine comprising a table on which a pair of mirrors are mounted, the pair of mirrors jointly reflecting light from a document 180° to a photosensitive surface. The table is supported for easy adjustment on a pair of eccentric cams mounted adjacent the ends thereof, the table being coupled to the cams by means of rotatable adjusting screws for establishing an initial level of the table.

7 Claims, 2 Drawing Figures

SUPPORT STRUCTURE FOR A DUPLICATOR OPTICAL SYSTEM

BACKGROUND OF THE INVENTION

This invention relates to an optical system for a duplicator machine, and more particularly to an optical system of a construction which allows easy adjustment and replacement as compared with existing counterparts.

The existing optical system for duplicator machines, for example, lenses and mirrors, generally undergo positional deviations due to vibrations occurring as a result of operation of the duplicator machine or imposed from outside, giving rise to various defects such as blurring of the original image on the copying surface or the like. These defects can be avoided by periodic adjustment of the optical system, but such adjustments involve troublesome efforts including positional and angular adjustments of lenses, and reflecting mirrors independently as well as in relation to other component parts of the optical system.

OBJECT OF THE INVENTION

The present invention aims at removing the aforementioned defects and has as its object the provision of an optical system particularly suitable for use in duplicator machines and having a simplified construction particularly designed to facilitate the positional adjustments to a material degree and at the same time to allow easy maintenance and replacement thereof.

DETAILED DESCRIPTION OF THE INVENTION

An embodiment of the present invention will now be described more particularly with reference to the accompanying drawings.

Figure 1:
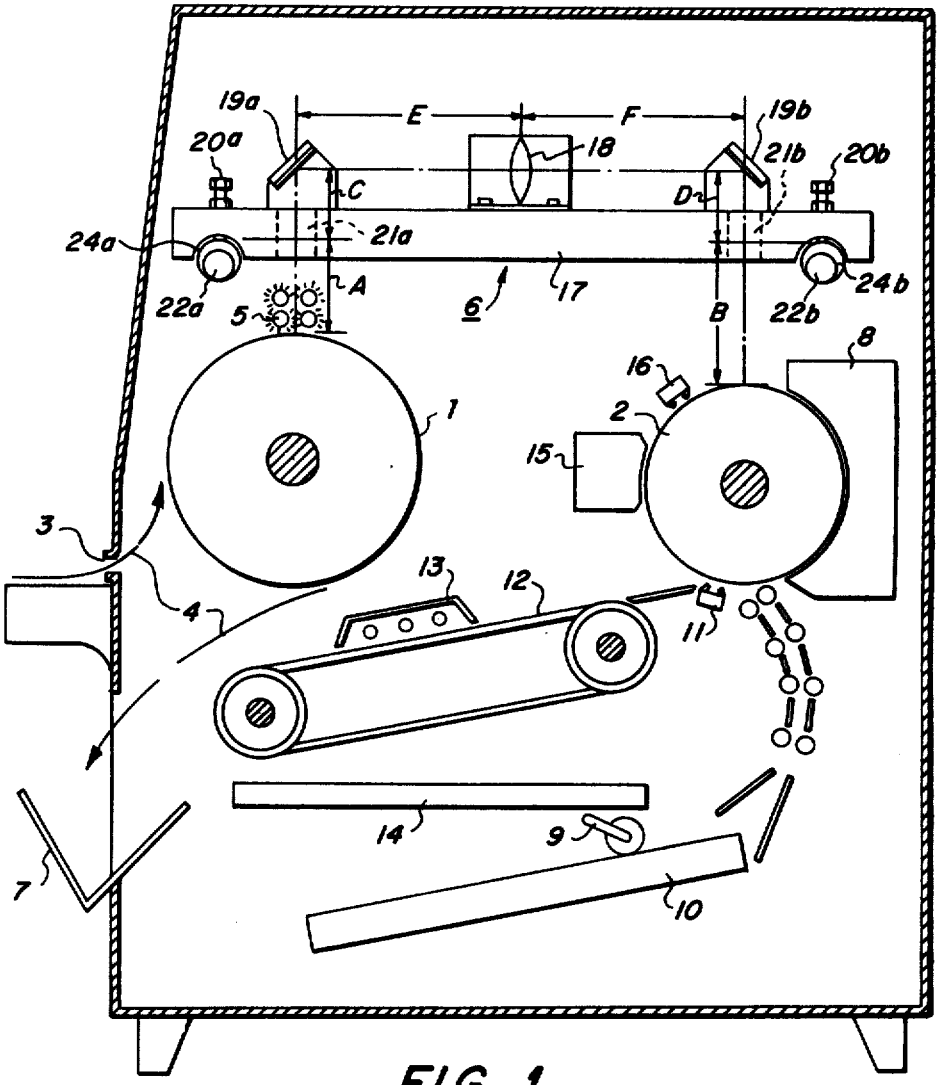
FIG. 1 is a diagramatic view showing general construction of a duplicator machine employing an optical system according to the present invention.
Figure 2:
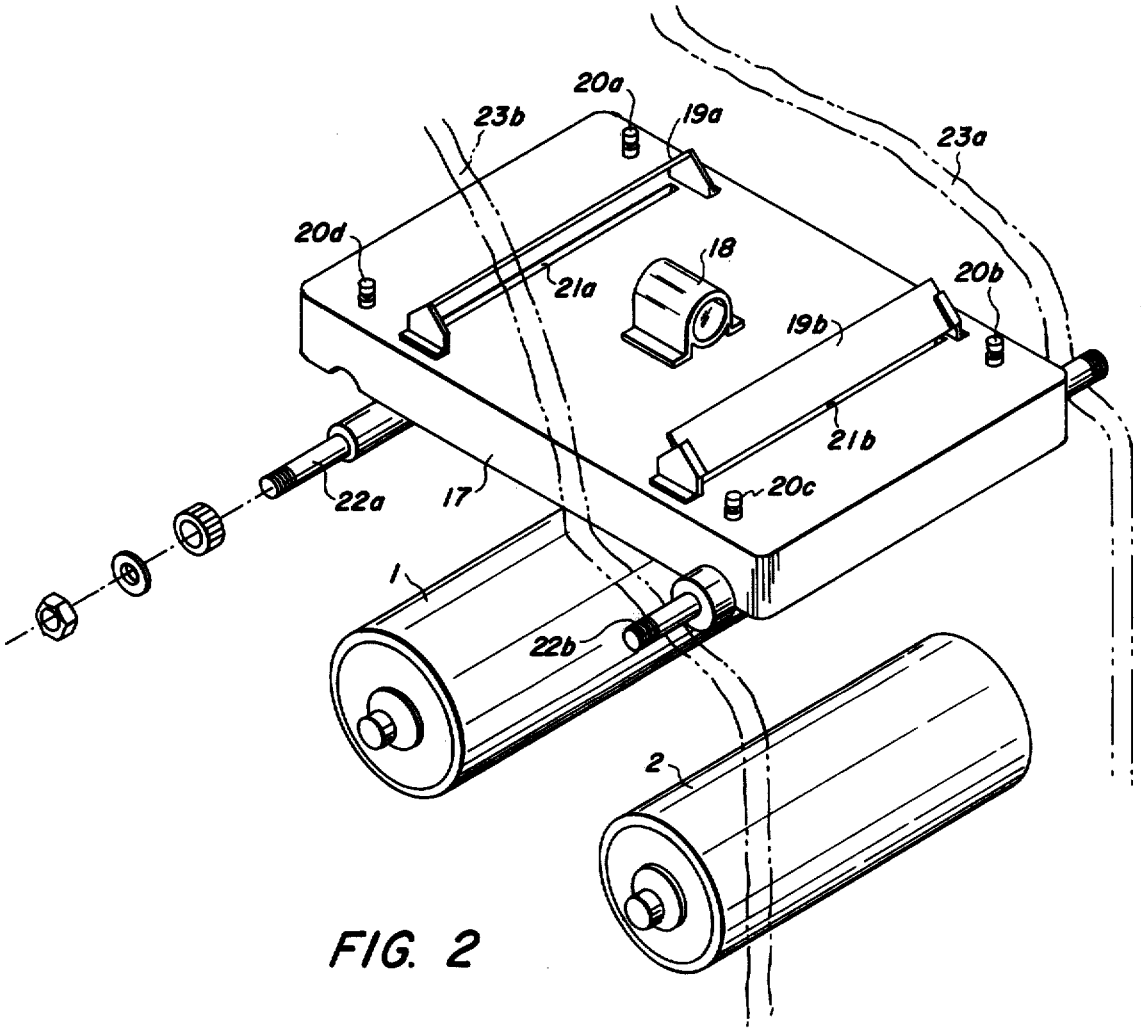
FIG. 2 is a perspective view showing the optical system of the present invention.

Referring to FIG. 1 which shows a general construction of a duplicator machine employing the optical system according to the present invention, there is designated at 1 a document drum and at 2 a photosensitive drum. An original document 4 which has been inserted through a document inlet 3 is transferred through an exposure position 5 by means of the document drum 1. An image of the original document 4 is formed as an electrostatic latent image on the photosensitive drum 2 by means of an optical system which will be described in greater detail hereinafter. Thereafter, the original 4 is discharged onto a document receptacle tray 7. The electrostatic latent image formed on the photosensitive drum 2 is visualized by means of a developing device 8 which is mounted on the circumference of the photosensitive drum 2 and the developed image is transferred at a transfer position onto a paper sheet 10 which is fed from a paper feeding device 9, by means of a transfer corona device 11. The paper sheet 10 which has been transferred with a visible image is directed to a fixing device 13 by the action of a chain 12, the fixing device operating to make the toner image permanent before the copy is discharged into the receptacle tray 14. Toner residue on the photosensitive drum 2 is removed by a cleaning station device 15.

In connection with a duplicator machine of the construction as mentioned hereinabove, the optical system 5 of the invention will be discussed hereafter.

The optical system 6 comprises a horizontally disposed table or platform 17 on which are mounted a lens 18, and reflecting mirrors 19*a* and 19*b*. Adjusting screws 20*a*, 20*b*, 20*c* and 20*d* are provided to form an independent optical unit. The lens 18 is fixedly mounted substantially at the center of the table 17 while the reflecting mirrors 19*a* and 19*b* are fixedly mounted at opposite ends thereof at approximately a 45° angle in facing relation with the document drum 1 and photosensitive drum 2, respectively. Thus, the light passage from the document drum 1 to the photosensitive drum 2 is constituted only by horizontal and vertical elements, so that the adjustment of focus may be attained suitably by moving the table 17 in the vertical direction. Elongated slots 21*a* and 21*b* are formed in the table 17 to permit light to pass between the document drum and the reflecting mirror 19*a* on the one hand between the photosensitive drum 2 and the reflecting mirror 19*b* on the other hand.

The aforementioned optical system 6 is supported on support members 22*a* and 22*b* which are suspended on the duplicator machine body and extended in the axial direction of the document drum 1 and photosensitive drum 2 between side walls 23*a* and 23*b*. The support members 22*a* and 22*b* are in the form of eccentric cams, so that the distances A and B of the vertical light passages between the uppermost levels of the document drum 1 and the support member 22*b* may be varied and adjusted by rotating the support members 22*a* and 22*b*, respectively. After adjustment, the support members 22*a* and 22*b* are fixed in position by suitable fixing means, such as nuts or the like.

In the manner just mentioned, the optical system 6 is mounted on the support members 22*a* and 22*b*. The bottom face of the table 17 of the optical system 6 is formed with two transversely extending semi-cylindrical grooves 24*a* and 24*b* for receiving the support members 22*a* and 22*b*. Therefore, the level of the table 17 may be adjusted by means of the adjusting screws 20*a*, 20*b*, 20*c* and 20*d* which are fixed in position by suitable fixing means such as double nuts or the like after adjustment of the table 17.

After mounting the optical system 6 on the support members 22*a* and 22*b*, the adjusting screws 20*a*, 20*b*, 20*c*, and 20*d* are set to satisfy the following equations:

$$C = (1 + 1/M)f - (A + B) \text{ and}$$
$$D = (1 + 1/M)f - (A + F)$$

wherein C is the vertical distance between the top level of the support member 22*a* in the form of an eccentric cam and the center of the reflecting mirror 19*a*, D is the vertical distance between the top level of the support member 22*b* in the form of an eccentric cam and the center of the reflecting mirror 22*b*, M represents the magnification of the lens, *f* represents the focal length of the lens, E represents the distance between the centers of the reflecting mirror 10*a* and the lens 19, and F represents the distance between the centers of the reflecting mirror 10*b* and the lens 18.

The setting of the adjusting screws 20*a*, 20*b*, 20*c*, and 20*d* may alternatively be effected visually by forming an image of the original on the photosensitive drum 2.

After setting the optical system 6 in position, both the optical system 6 and the support members 22*a* and 22*b* are fixed immovable with respect to each other by suitable fixing means such as a band or a clamping device (not shown).

As described hereinbefore, the optical system for a duplicator machine according to the present invention comprises on the table 17, a first reflecting mirror 19*a* for reflecting a light ray emitted in a normal direction from the surface of an original on the document drum 1 in a direction perpendicular to a line normal to the surface of the original, a lens 18 disposed in the passage of the reflected light ray, and a second reflecting mirror 19*b* for reflecting the received beam 90° and projecting the light rays onto a photosensitive drum 22*a*, the table 17 being coupled to support members 22*a* and 22*b*, by means of a plural number of adjusting screws 20*a*, 20*b*, 20*c*, and 20*d* to allow adjustment of the level of the table. The support members are supported from the machine frame so that the table 17 may be adjusted in the vertical direction with ease by rotation of the support members which are in the form of eccentric cams spaning the width of the table parallel to the plane of the reflecting mirrors. The optical system thus has the advantage of allowing easy maintenance and replacement.

What is claimed is:

1. In a duplicator machine having a document drum and a photoconductor drum, an optical system comprising a table on which are fixedly mounted two spaced apart mirrors, said mirrors arranged to jointly reflect light from said document drum approximately 180° to said photoconductor drum, a pair of eccentric cams supported with their longitudinal axes substantially parallel to the plane of said table, means for supporting said cams for rotation about their longitudinal axes, adjusting screws carried for rotation in said table and having ends bearing on said cams, whereby said table may be adjusted relative to said drums by the combined movement of said adjusting screws and cams.

2. The combination recited in claim 1 wherein said table includes openings intermediate said mirrors and each of said drums for the passage of light.

3. The combination recited in claim 2 wherein said cams are carried in side frame members of said machine.

4. The combination recited in claim 1 wherein said cams are located adjacent opposite ends of said table and each cam has a pair of adjusting screws bearing thereon.

5. An optical system for a duplicator machine for reflecting light from a document drum to a photoconductor drum through approximately 180° comprising a table having a pair of mirrors mounted thereon, a pair of eccentric cams mounted for rotation in said machine, said table supported on said cams whereby rotation of said cams changes the position of said table relative to said drums.

6. The combination recited in claim 5 wherein said table has slots in the light path between each of said mirrors and its associated drum, and said cams are coupled to said table by means of adjusting screws carried for rotation in said table and having ends which bear on said cams.

7. The combination recited in claim 6 wherein said cams have their longitudinal axes running parallel to the plane of said table and span the width of said table in the direction of orientation of said mirrors.

* * * * *